US008398460B2

(12) United States Patent
Christopher

(10) Patent No.: US 8,398,460 B2
(45) Date of Patent: Mar. 19, 2013

(54) APPARATUS AND METHOD FOR DISPENSING ABRASIVE PARTICULATE MATERIAL INTO A STREAM OF GAS

(75) Inventor: Richard Christopher, Wrexham (GB)

(73) Assignee: Whirlwind Utilities Limited, Wrexham (GB)

( * ) Notice: Subject to any disclaimer, the term of this patent is extended or adjusted under 35 U.S.C. 154(b) by 602 days.

(21) Appl. No.: 12/440,559

(22) PCT Filed: Sep. 7, 2007

(86) PCT No.: PCT/GB2007/003369
§ 371 (c)(1),
(2), (4) Date: Mar. 13, 2009

(87) PCT Pub. No.: WO2008/029149
PCT Pub. Date: Mar. 13, 2008

(65) Prior Publication Data

US 2009/0270016 A1 Oct. 29, 2009

(30) Foreign Application Priority Data

Sep. 7, 2006 (GB) ..... 0617650.7

(51) Int. Cl.
*B24B 1/00* (2006.01)

(52) U.S. Cl. ..... 451/38; 451/61; 451/76; 451/99; 451/100

(58) Field of Classification Search ..... 451/38, 451/61, 76, 99, 100
See application file for complete search history.

(56) References Cited

U.S. PATENT DOCUMENTS

| | | | | | |
|---|---|---|---|---|---|
| 1,473,757 | A | * | 11/1923 | Dorsey | 406/130 |
| 1,890,164 | A | * | 12/1932 | Rosenberger | 451/38 |
| 2,087,694 | A | * | 7/1937 | Malmros | 451/37 |
| 2,173,364 | A | * | 9/1939 | Jesser | 451/80 |
| 3,139,704 | A | * | 7/1964 | McCune | 451/76 |
| 3,824,738 | A | * | 7/1974 | Hall et al. | 451/76 |
| 3,914,815 | A | * | 10/1975 | Kobayashi | 15/3.5 |
| 4,081,930 | A | * | 4/1978 | Jones | 451/38 |
| 4,502,820 | A | | 3/1985 | Fujii et al. | |
| 4,862,649 | A | * | 9/1989 | Davis et al. | 451/38 |
| 6,000,995 | A | * | 12/1999 | Ruholl | 451/2 |
| 6,890,246 | B2 | * | 5/2005 | Yamaharu | 451/99 |
| 6,988,935 | B2 | * | 1/2006 | Shiraishi et al. | 451/38 |
| 2005/0107005 | A1 | | 5/2005 | Lynn | |

FOREIGN PATENT DOCUMENTS

| | | | |
|---|---|---|---|
| DE | 3533667 | A1 * | 4/1987 |
| EP | 0521794 | | 1/1993 |
| EP | 1214989 | A2 | 6/2002 |
| EP | 1214989 | A2 | 6/2002 |
| EP | 1331183 | A1 | 7/2003 |
| GB | 399730 | A | 10/1933 |
| GB | 1090181 | | 11/1967 |

(Continued)

*Primary Examiner* — George Nguyen
(74) *Attorney, Agent, or Firm* — Gifford, Krass, Sprinkle, Anderson & Citkowski, P.C.; Mark D. Schneider

(57) ABSTRACT

Apparatus for dispensing abrasive particulate material into a stream of gas, the apparatus comprising:

a. a pressurized hopper for receiving particulate abrasive material; and b. a pressurized conveyor coupled to the hopper comprising a housing having an inlet for receiving particulate material from the hopper, an outlet for delivery of particulate material from the housing, and a screw located within the housing for transporting particulate material from the inlet to the outlet.

Also provided is a method of dispensing particulate abrasive using said apparatus and a pipe cleaning system including said apparatus.

7 Claims, 3 Drawing Sheets

FOREIGN PATENT DOCUMENTS

| | | | | |
|---|---|---|---|---|
| GB | 1315941 | A | | 5/1973 |
| GB | 2140337 | | | 11/1984 |
| GB | 2147397 | A | | 5/1985 |
| JP | 60263671 | A | * | 12/1985 |
| JP | 63144961 | A | * | 6/1988 |
| JP | 06270065 | A | | 9/1994 |
| WO | WO-03013790 | A1 | | 2/2003 |

* cited by examiner

APPARATUS AND METHOD FOR DISPENSING ABRASIVE PARTICULATE MATERIAL INTO A STREAM OF GAS

CROSS-REFERENCE TO RELATED APPLICATIONS

This application is the U.S. national phase of PCT/GB2007/003369 filed Mar. 13, 2008, which claims priority of Great Britain Patent Application 0617650.7 filed Sep. 7, 2006.

BACKGROUND TO THE INVENTION

The present invention relates to a dispensing apparatus. In particular, the present invention relates to an apparatus for dispensing abrasive particulate material into a stream of gas in a pipe for the purpose of cleaning the internal pipe walls and a method of cleaning internal pipe walls using such an apparatus.

Tubercles form as a result of corrosion inside steel and cast water mains and consist of layers of corrosion products, such as rust and the like, which build up over time to form lumps and mounds over local areas of metal loss.

Tubercles can severely reduce the internal bore of pipes, leading to reduced flow and a necessary increase in pumping pressure to maintain a supply of water though the pipe.

Current methods of removal of tubercles involve the use of steel flails, rotated inside the pipe on rotating rods, impacting the pipe wall and chipping off the tubercle growth. This method uses large quantities of water to flush away loosened tubercle debris from inside the pipe and this dirty waste water is dumped to surface drains, which is clearly not environmentally desirable. In addition, the physical action of the steel flails impacting the pipe wall can dislodge the pipe at the pipe joints, thereby causing leaks in the pipeline supply.

There are several existing methods of cleaning pipes which use material such as sand or rocks blown through a pipe to act as scourers to dislodge tuberculation thereby clearing debris from the internal pipe wall. However, such methods are often unsuccessful and they fail to deliver the material into the pipe in a measured and controlled way to ensure that there is effective cleaning whilst minimising/preventing damage to the internal walls of the pipe from impaction by the aggregate material.

There is therefore a need for an effective and reliable method of delivery of aggregate material into a pipe in a controlled manner so as to minimise/prevent damage to the internal walls of the pipe whilst maximising the cleaning of debris from the interior surfaces of the pipe during the cleaning process.

SUMMARY OF THE INVENTION

The present invention seeks to address the problems of the prior art.

Accordingly, a first aspect of the present invention provides an apparatus for dispensing particulate abrasive material into a stream of gas, the apparatus comprising:

Apparatus for dispensing abrasive particulate material into a stream of gas, the apparatus comprising:

a. a pressurised hopper for receiving particulate abrasive material; and b. a pressurised conveyor coupled to the hopper comprising a housing having an inlet for receiving particulate material from the hopper, an outlet for delivery of particulate material from the housing, and a screw located within the housing for transporting particulate material from the inlet to the outlet.

The use of a screw conveyor has the advantage of allowing controlled and measured even delivery of the abrasive material into the stream of gas. The abrasive material is delivered from the hopper to the conveyor, for example by means of gravitational force and/or under pressure or by any other suitable means known to the skilled person, where the abrasive material fills the voids between the screw and conveyor housing before being moved through the conveyor housing on operation of the screw. In this way, there is a constant delivery of abrasive material into the stream of gas. The rate of delivery can be controlled by adjusting the speed of the screw and/or the volume of the voids between the screw and conveyor housing.

In one embodiment, the hopper and the conveyor are pressurised to above a predetermined pressure which is the same as the pressure in the pipeline.

The particulate preferably conforms to one of more of the following conditions:

1. a hardness of greater than or equal to 6.5 on the Mohs scale;
2. falls within the following definitions as cited in BS EN 933 Part 5, Section 3, subsections 3.5—totally crushed or broken particle, having more than 90% of its surface crushed or broken (crushed or broken surfaces shall mean: facets of a particle of gravel produced by crushing or broken by natural forces and bound by sharp edges and optionally an angularity of >90%);
3. specific gravity of no less than 2.5 g/cm3 and possess a bulk density of between 1.3 and 1.6 g/cm3;
4. be of igneous origin;
5. graded to 10 mm, 20 mm and/or 30 mm; and
6. thoroughly washed and dried and all fines removed.

Whilst many particulate materials may be used, preferably the particulate material is one or more of flint, chert, granite or any other suitable aggregate known to the skilled person or any suitable man-made particulate material, such as cut pieces of steel or the like.

The particulate material is placed into the turbulent airflow and propelled to the opposite end of the pipe. The turbulent airflow is moving faster in the centre of the pipe that it is at the walls and therefore automatically hurls the particulate material at the interior surface of the pipe. The cleaning process is achieved when the combination of the speed of the turbulent air, the weight and the sharpness of the particulate material is sufficient to impinge on the crusty outer casing of the tubercles breaking this crust off and exposing the softer damp corroding layer underneath, which is easily removed by subsequently impinging particulate material.

The particulate material constantly impinges on the wall of the pipe during its travel through the pipe section and an uneven distribution results in loss of propulsion and blockages.

Therefore, for such a system to work properly, it is important that the particulate material is added to the airflow in an even and controlled a manner so as to provide an even distribution throughout the pipe. This is achieved by means of the screw conveyor, and in particular, a pressurised screw conveyor supplied with particulate material from a pressurised hopper, as discussed above. Screw conveyors provide the advantage of being able to distribute the particulate material evenly and allow the starting and stopping of distribution and delivery of the particulate material into the gas stream without creating blockages in the system.

In one embodiment, the conveyor is adapted to feed particulate material into the gas stream at a rate of between 150 and 500 kg per hour. More preferably, the conveyor is adapted to feed particulate material into the gas stream at a rate of between 200 and 400 kg per hour, and in particular at a rate of between 250 and 350 kg per hour.

A typical quantity of particulate material needed to clean a section of pipeline would be between 100 and 500 kg.

The amount of contamination in the pipeline has a greater influence on the quantity of aggregate used, rather than the length of the pipeline, as the aggregate works along the entire length of the pipeline with little or no degradation in the cleaning action.

The screw may be hydraulically powered. Alternatively, the screw may be mechanically driven or may be driven by any other suitable means known to the skilled person.

In one embodiment, the conveyor is operable to drive the screw in either a forward or an opposing reverse direction. This has the advantage that the direction of the screw can be reversed when desired to free any particulate material which may have become jammed within the apparatus prior to reaching the gas stream.

The apparatus may further comprise an air feed providing the stream of gas into which the particulate material is passed in use.

A further aspect of the present invention provides a method of cleaning pipes, said method comprising the steps of:

a. Providing an air stream within a pipe to be cleaned;
b. Providing an apparatus in accordance with any one of claims 1 to 6 in communication with the air stream;
c. Providing abrasive particulate material into the hopper; and
d. Pressurising the hopper and the conveyor; and
e. Operating the conveyor so as to rotate the screw and move the particulate material through the conveyor and into the air stream.

BRIEF DESCRIPTION OF THE DRAWINGS

An embodiment of the invention will now be described, by way of example only, and with reference to the accompanying drawings, in which.

DETAILED DESCRIPTION OF THE INVENTION

Figure 1:
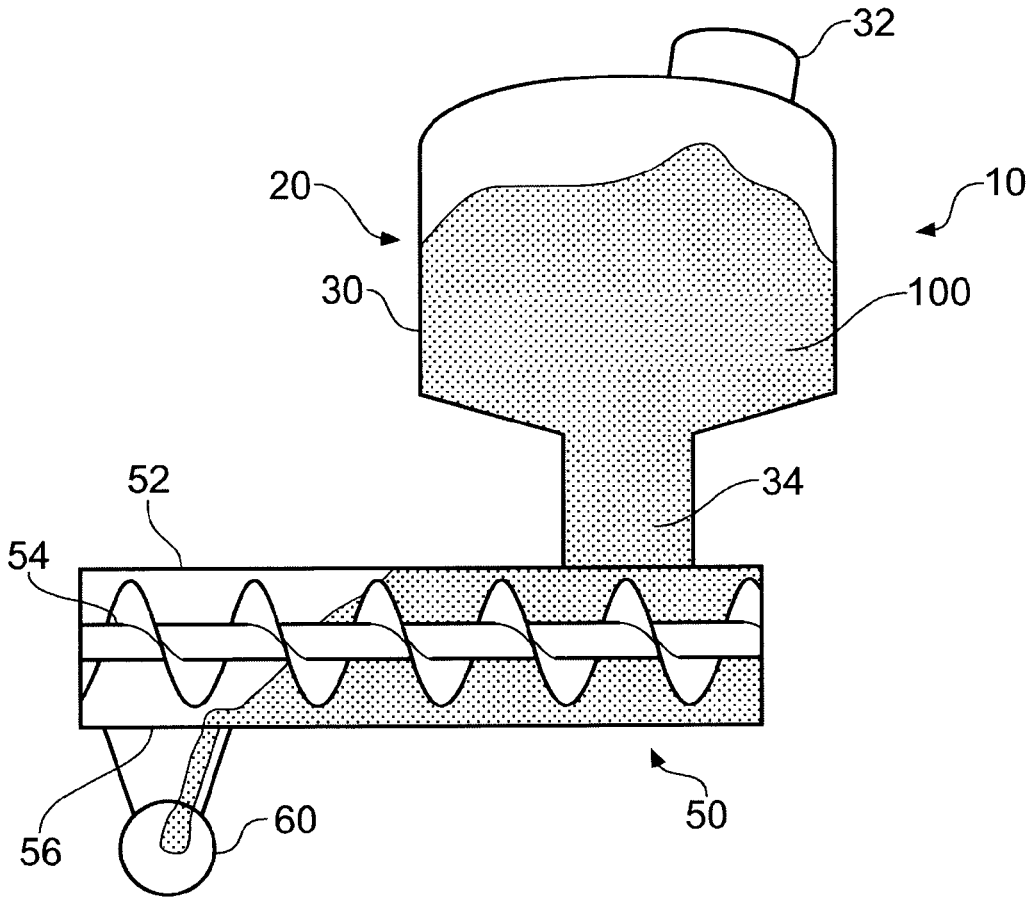
FIG. 1 is an illustration of a first embodiment of a dispensing apparatus in accordance with the present invention.

The embodiment of FIGS. 1 to 3 will now be discussed below:

Apparatus 10 comprises an aggregate hopper 20, having a housing 30 with an inlet 32 through which aggregate 40 may be fed into the hopper 20. Hopper 20 also has an outlet 34 which is engaged with a screw conveyor 50 comprising a housing 52 and a screw 54 located within housing 52 and arranged to convey aggregate along at least a portion of the length of housing 52 to exit 56 through which aggregate leaves the conveyor and enters a pressurised air stream travelling through the portion of pipe 60.

In use, aggregate 100 is fed into hopper 20 through inlet 32 in housing 30. The hopper 20 is pressurised and the aggregate is directed by gravity downwards towards screw conveyor 50 through connecting passage 36. On entering the conveyor, the aggregate fills up any void space around the screw 54 between the screw 54 and the walls 56 of conveyor housing 52. Aggregate 100 is then moved through housing 52 of conveyor 50 at a controlled rate so as to be delivered in a measured manner out of housing 52 of conveyor 50 and into a pressurised air stream (not shown in FIG. 1).

Figure 2:
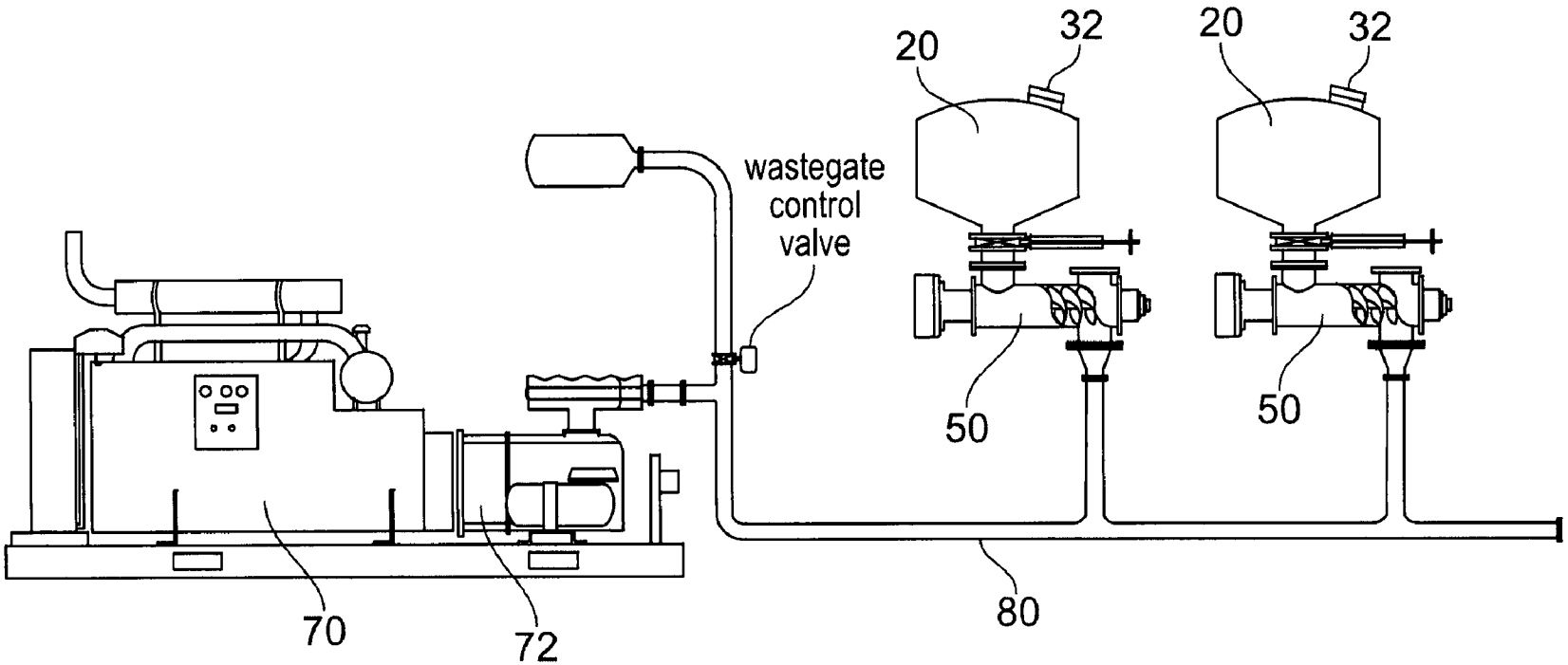
FIG. 2 is an illustration of a cleaning system incorporating the embodiment of FIG. 1.
Figure 3A:
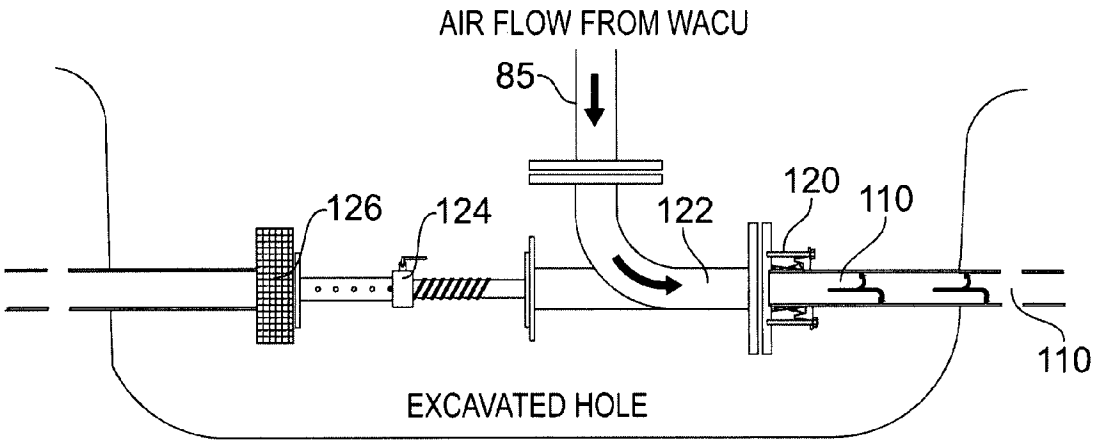
FIGS. 3A and 3B are further illustrations of part of the cleaning system of FIG. 2, showing a portion of the pipeline being cleaned.
Figure 3B:
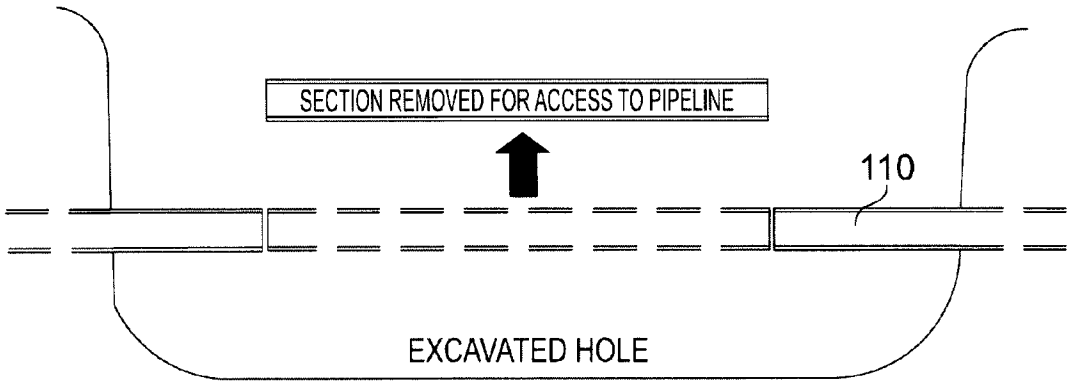

As can be seen in FIG. 2, two hopper and conveyor arrangements may be used in the described embodiment to clean a section of pipe 60.

Two diesel engine units 70 are provided at a first end of the pipeline 110 to be cleaned, each diesel unit driving a separate helical blower 72. The helical blowers 72 can be operated individually or in parallel to product a turbulent air flow under pressure. Although the described embodiment employs two diesel engine units 70 each driving a separate helical blower 72, it is to be appreciated that one diesel engine unit 70 could be employed to drive more than one helical blower 72 or two or more diesel engine units 70 may be used to drive any desired number of helical blowers 72.

Outlet pipework 80 is connected to the blower outlet via a flanged, flexible stainless steel hose to remove vibration from the outlet pipework. Air from the blowers 72 is discharged into outlet pipework 80 via the hose.

The outlet pipework 80 is connected via flexible hose 85 to the pipeline 110 to be cleaned. The pipework 110 to be cleaned is fitted with a VJ coupling 120 attached to a ducks-foot bend 122. The VJ coupling 120 and bend 122 are strutted-off against the pipe opposite to prevent the coupling dislodging from the pipeline when under pressure using acrow strut 124 and wooden block 126. However, it will be appreciated that any suitable arrangement securing the coupling outlet pipework 80 and pipeline 110 may be used as an alternative to, or in combination with, the arrangement described.

The propulsion properties of air through the pipeline 110 in the embodiment described is as follows:

Propulsion

High volume: achieving at least 60 m per second and preferably 90 m per second.

Low Pressure: Maximum 2.5 bar.

Quality: 100% oil free

It has been found that if a high enough velocity is achieved within the pipeline 110 that turbulent airflow is achieved. This is produced by the drag effect of the internal wall of pipeline 110 slowing down the airflow adjacent to the wall. The greater the velocity of the airflow, the larger the differential in flow between that at the centre of pipeline 110 and at the wall of pipeline 110, and thus the greater the turbulence of the airflow in pipeline 110.

The turbulence can be maintained around bends so as not to limit the use of the system to straight pipelines only. Where T-pieces are installed in the pipeline 110 the flow turns slightly more laminar as there is no wall to slow the air and create turbulence therefore allowing the aggregate to continue along the pipe and not to enter the off-take of the T-piece.

The size of the blowers 72 is selected so as to allow the generation of sufficient flows to enable a constant and controlled flow rate to be maintained throughout the whole system, thereby eliminating any requirement to store energy and release it in bursts or the need to generate greater pressures to provide the required quantity of air through the pipeline 110.

The pressure generated by the blowers 72 is controlled by the use of a suitable pressure control device which controls a waste gate arrangement in the main discharge line from the pipeline 110, thus allowing the operator to control the amount of pressure in the system and enabling the apparatus of the system to achieve:

1. a low pressure i.e. <0.5 bar, for bulk water removal, thus maintaining essential control and ensuring a safe working environment during the operation of the apparatus; and
2. a greater pressure of 2.5 bars when required for cleaning purposes.

The blowers 72 produce hot air at around 150° C. this is a result of both the mechanical operation of the diesel engine units 70 and the heat energy converted during pressurisation of the air. This heat is used during the operation to dry the inside wall of the pipeline 110. In drying the wall and its contamination, the contaminates, i.e. tubercles, dry out and become brittle enabling easier removal.

The present invention is capable of successfully cleaning heavily contaminated pipes of between 80 mm and 150 mm diameter and up to 1000 meters in length, although it will be appreciated that longer lengths and greater diameter pipes may be cleaned using the present invention. Further, the process may be adapted to accommodate any size of pipe by appropriate selection of equipment to achieve the desired air pressures etc. It is preferably that the apparatus carrying out the cleaning operation is easily portable to allow ease of transportation of the apparatus to different sites where pipelines require cleaning. However, where the scale of the operation demands that the equipment used is too large to be easily portable, it will be appreciated that the apparatus may be assembled onsite, used to clean the pipeline, and then disassembled and transported to a fresh site before being reassembled for use.

Although aspects of the invention have been described with reference to the embodiment shown in the accompanying drawings, it is to be understood that the invention is not limited to the precise embodiment shown and that various changes and modifications may be effected without further inventive skill and effort.

The invention claimed is:

1. A pipe cleaning apparatus for attachment to a pipe to be cleaned, and operable to dispense abrasive particulate material into a stream of gas within such a pipe to be cleaned, comprising:

a pressurised hopper for receiving particulate abrasive material;

a pressurised conveyor coupled to the hopper and comprising a housing having an inlet for receiving particulate material from the hopper in a first direction, an outlet for delivery of particulate material from the housing in a direction substantially parallel to the first direction, and a screw located within the housing to transport particulate material from the inlet toward the outlet in a second direction substantially transverse to the first direction, wherein the outlet is shaped for attachment to the pipe to be cleaned and configured to deliver the particulate material into a stream of gas; and an air feed in communication with the outlet and providing the stream of gas into a pipe to be cleaned, the stream of gas travelling at a velocity sufficient to achieve a turbulent flow into which the particulate material is delivered.

2. The apparatus of claim 1, wherein the hopper and the conveyor are pressurized to a predetermined pressure.

3. The apparatus of claim 1, wherein the particulate material comprises one or more of flint, chert, and granite.

4. The apparatus of claim 1, wherein the conveyor feeds particulate into a gas stream at between 200 and 400 kg per hour.

5. The apparatus of claim 1, wherein the screw is hydraulically powered.

6. The apparatus of claim 1, wherein the conveyor drives the screw in either a forward or an opposing reverse predetermined direction.

7. A method of cleaning pipes comprising:

providing an air stream within a pipe to be cleaned, the stream including an air stream of a gas travelling at a velocity sufficient to achieve turbulent flow;

providing an apparatus in communication with the air stream for dispensing abrasive particulate material into the air stream of gas, the apparatus comprising a pressurised hopper for receiving particulate abrasive material and a pressurised conveyor coupled to the hopper, the conveyor including a housing having an inlet for receiving particulate material from the hopper in a first direction, an outlet for delivery of particulate material from the housing in a direction substantially parallel to the first direction, and a screw located within the housing for transporting particulate material from the inlet toward the outlet in a second direction that is substantially transverse to the first direction, the outlet being shaped to engage an end of a pipe to be cleaned;

providing abrasive particulate material into the hopper; and operating the conveyor so as to rotate the screw and move the particulate material through the conveyor, directly into the turbulent flow of the air stream, and then into the pipe to be cleaned.

* * * * *